United States Patent [19]

Bloom et al.

[11] 4,062,063

[45] Dec. 13, 1977

[54] CAP COVER CONNECTORS

[75] Inventors: Bernard Bloom, Chicago; Benjamin Lev, Skokie, both of Ill.

[73] Assignee: Midway Cap Company, Chicago, Ill.

[21] Appl. No.: 551,981

[22] Filed: Feb. 24, 1975

Related U.S. Application Data

[63] Continuation of Ser. No. 304,191, Nov. 6, 1972, abandoned, which is a continuation-in-part of Ser. No. 173,828, Aug. 23, 1971, abandoned.

[51] Int. Cl.[2] ..... A42C 5/00

[52] U.S. Cl. ..... 2/187; 24/222

[58] Field of Search ..... 2/187, 197, 96, 128, 2/139, 175, 195; 24/208, 222 R, 222 BS, 219

[56] References Cited

U.S. PATENT DOCUMENTS

| | | | |
|---|---|---|---|
| 2,281,999 | 5/1942 | Rieback | 24/222 R |
| 2,416,062 | 2/1947 | Mercer | 2/177 |
| 3,142,843 | 8/1964 | Berger | 2/128 |

FOREIGN PATENT DOCUMENTS

| | | | |
|---|---|---|---|
| 404,693 | 3/1924 | Germany | 2/139 |

*Primary Examiner*—Werner H. Schroeder
*Assistant Examiner*—Peter Nerbun
*Attorney, Agent, or Firm*—Wegner, Stellman, McCord, Wiles & Wood

[57] ABSTRACT

A self-aligning snap fastener construction for use in cap constructions including cap frames with removable covers secured thereto, upholstery covers, clothing and the like. The snap fastener is formed of mating male and female elements, one of which may be fixedly secured to one of the two elements to be connected together and the other of which is movably fixed to the other element to be connected together. In the preferred embodiment, an elongated slotted member is connected to an element and the connecting portion of the male snap connector extends through the slot to be received in the female connector. By reason of the slot, the male member is permitted to move to align with the female snap connector when the elements are connected together.

3 Claims, 8 Drawing Figures

Fig. 1.
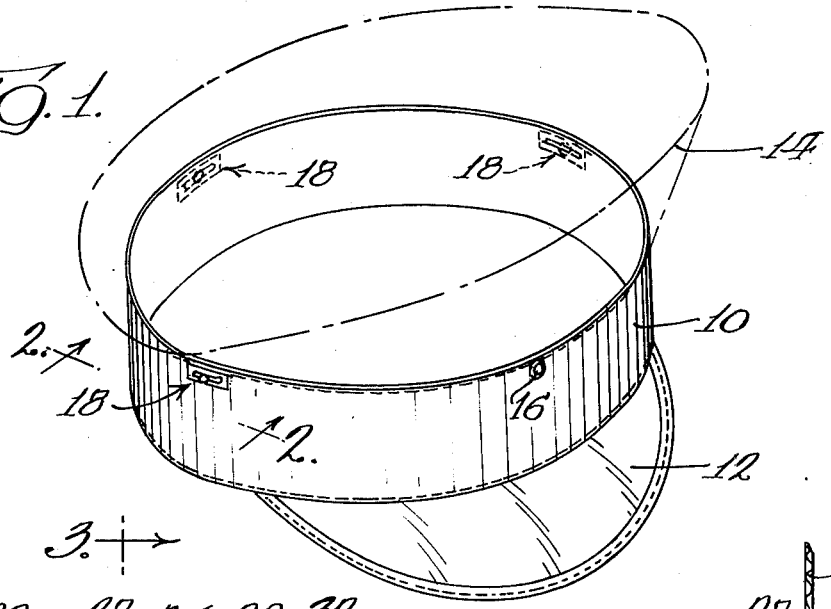
Fig. 2.
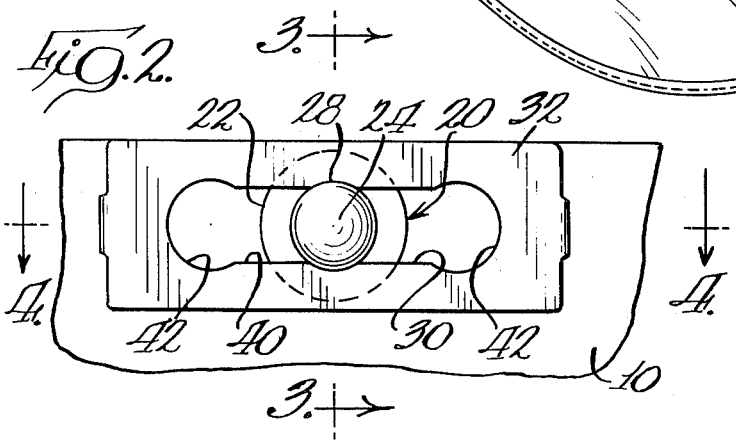
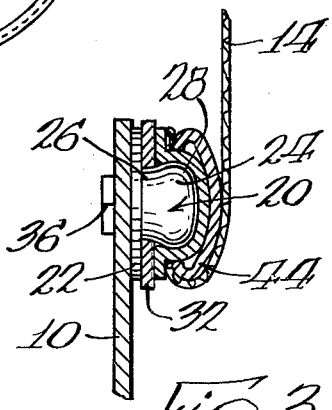
Fig. 3.
Fig. 4.
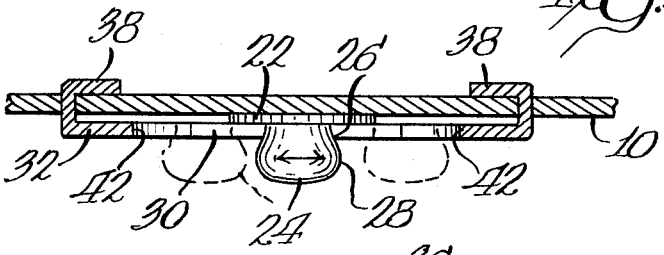
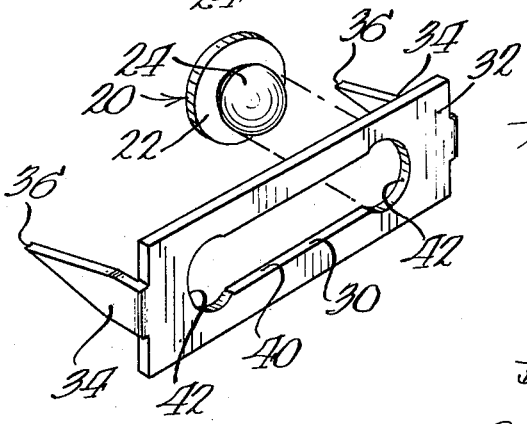
Fig. 5.
Inventors:
Bernard Bloom
Benjamin Lev
By Hofgren, Wegner,
Allen, Stellman & McCord Attys

CAP COVER CONNECTORS

CROSS-REFERENCE

This application is a continuation of our co-pending application Ser. No. 304,191, filed Nov. 6, 1972 now abandoned, which in turn is a continuation-in-part of our application Ser. No. 173,828, now abandoned, filed Aug. 23, 1971.

BACKGROUND OF THE INVENTION

This invention relates to snap fasteners, and more particularly, to snap fasteners wherein the two components are self-aligning.

Snap fasteners of the type including a male and a female member are employed in a variety of ways to fasten two or more elements together. Frequently, a series of such fasteners are employed to interconnect two different elements, and in such instances, it is necessary that there be precise alignment between the various components of each snap fastener and the remaining snap fasteners to preclude alternate bunching and stretching of the material being secured together, resulting in a displeasing appearance.

For example, cap constructions such as uniform caps have been formed of cap frames and cap covers, the latter, being removably secured to the former, to allow removal for cleaning purposes and/or to provide interchangeability of varying styles of covers with a given cap frame. In a typical construction, the cover is secured to the cap frame at a plurality of peripheral locations, usually four, by complementary securing elements, some being secured to the frame and some being secured to the cover. Typically, the connectors will be snap connectors having a male element secured to the frame and a female element secured to the cover.

To provide a suitable appearing cap construction using the foregoing prior art technique, is sometimes difficult and exacting. Frequently, the connecting elements on the cover are not spaced about the same identically to the spacing of the connecting elements about the periphery of the frame. That is, the various connectors on the cover may not be properly aligned with the respective connectors on the frame. Although such misalignment may not seem, at first blush, to be a serious problem, it has been found that misalignments only on the order of about ⅛ of an inch can cause sufficient bunching of one portion of the cover and significant stretching of an adjacent portion of the cover, as to completely destroy the pleasing appearance of the cap construction.

Of course, the problem is increased, as frequently the errors in alignment are cumulative. For example, if when starting at any desired point of origin on the cap frame or the cover and moving peripherally around the same to the first connector, it is found that there is one-eight of an inch error in alignment and there is a similar misalignment as between the first connector and the second connector, the error from the point of origin to the second connector will be one-quarter of an inch. When such errors accumulate, not infrequently, it is virtually impossible to even fit a cover on the frame.

Similar problems occur in other usages of snap fasteners. For example, snap fasteners are frequently employed in upholstery covers and various types of clothing. When employed in upholstery covers, small misalignments can result in bunching and stretching of the material. In the case of clothing, snap fasteners are frequently employed, for example, in the flies of various garments and if not properly aligned, substantially detract from the appearance of the garment on the wearer due to such alternate bunching and stretching.

Thus, when such errors occur, it has been necessary to manually disassemble the connecting elements and relocate them in proper alignment. Usually this is accomplished by removing the connecting element on the frame and relocating the same. Such corrections must be accomplished manually with the result that a significant expenditure of labor is required.

SUMMARY OF THE INVENTION

It is the principal object of the invention to provide a new and improved snap fastener construction. More specifically, it is an object of the invention to provide a snap fastener construction wherein at least one of the male and female elements is movably mounted on one of the elements to be secured together by the fastener in such a way that a fastening function is properly performed but allowing limited movement to compensate for alignment errors during initial construction whereby bunching and stretching of the material between adjacent fasteners or seams is eliminated thereby obviating any need for manual disassembly of connectors from the elements to which they are secured and subsequent reassembly to insure proper alignment.

The exemplary embodiment of the invention achieves the foregoing objects by the provision of an elongated slot in one of the elements to be secured together by the snap fastener in which one of the fastener components is received for longitudinal movement in the direction in which proper alignment is desired. The slot may be provided either directly in the material to be secured together or may be in a separate clip-like element secured to the material to be secured together by the snap connector.

With reference to, for example, a cap construction, the exemplary embodiment of the invention achieves the foregoing objects with a construction wherein at least some of the connecting elements on at least one of the cap frame and the cap cover are movably mounted thereon so that, when misalignment occurs, the location of one of the connectors can easily be shifted to a position of proper alignment during standard cover to frame assembly processes.

More particularly, connecting elements about the periphery of a cover in the form of female snap connectors are provided. The cap frame is provided with a plurality of slots, each movably mounting a male snap connector. Thus, when misalignment occurs, the male snap connector may be shifted along the periphery of the frame within its associated slot until it is in proper registry with its associated female snap connector at which time a releasable, snap connection may be established.

According to the preferred embodiment, the slots in the frame are defined by clips each having a slot therein. The protuberance of the male snap connector is received in the slot and projects therethrough to be received in the female snap connector on the cover. The clip may be secured to the frame by means of tabs penetrating the frame and bent over behind the same.

In addition, each of the slots may be provided with an enlarged opening through which the protuberance on the male connector may be received with a major portion of the slot being of a lesser dimension so as to permit sliding movement of the male snap connector but prevent withdrawal of the same to assist the ease of assembly of the connectors to the frame.

As will become apparent from the following specification, the foregoing features of the invention are applicable to a variety of goods other than cap constructions.

Other objects and advantages will become apparent from the following specification taken in conjunction with the accompanying drawings.

DESCRIPTION OF THE DRAWINGS

FIG. 1 is a perspective view of a cap construction made according to the invention with the cover thereof shown only in dotted line form to allow the full view of the connection means of the invention;

FIG. 2 is a side elevation of a connector embodied in the invention taken approximately along the line 2—2 of FIG. 1;

FIG. 3 is a vertical section taken approximately along the line 3—3 of FIG. 2;

FIG. 4 is a horizontal section taken approximately along the line 4—4 of FIG. 2;

FIG. 5 is an exploded view of a portion of the connector;

DESCRIPTION OF THE PREFERRED EMBODIMENTS

Figure 6:
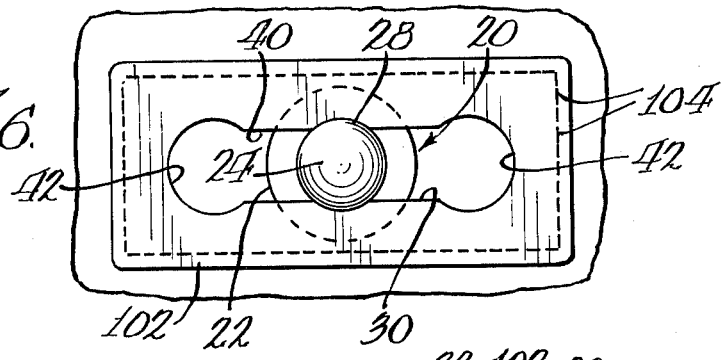
FIG. 6 illustrates a modified embodiment of a portion of the connector.

An exemplary embodiment of a cap construction made according to the invention is illustrated in FIG. 1 and is seen to include the cap frame 10 having a forwardly projecting bill 12, and a cover 14. Means (not shown) may be secured to the frame 10 for shaping the cover 14 as desired. The cover 14 is secured to the frame 10 at four, approximately equally spaced points about the periphery of the latter. For example, a forwardmost point may include an outwardly projecting male snap connector 16 of conventional construction secured to the upper edge of the frame in a conventional way. At the remaining points about the periphery of the cap frame 10, connecting means, generally designated 18, each including a movably mounted connecting element are provided.

As best seen in FIGS. 2–5, inclusive, each of the connecting means 18 includes a conventional male snap connector, generally designated 20, having an enlarged, generally planar base 22 from which a protuberance 24 extends. As best seen in FIG. 3, a portion 26 of the protuberance 24 intermediate the base 22 and the outermost extent of the protuberance 24, has a lesser dimension than a more outwardly portion 28 of the protuberance 24.

Each of the male snap connectors 20 is received in an associated slot 30 near the upper end of the frame 10. According to the preferred embodiment, each slot 30 is defined by a metal clip 32 secured to the frame 10 by inwardly turned tabs 34. The tabs 34 have pointed ends 36 for penetrating the frame 10 and, as may best be seen in FIG. 4, may be bent over as at 38 to fixedly secure the clip 32 to the frame 10. The slot 30 is, of course, elongated along the periphery of the frame 10 and further includes an intermediate portion 40 having a width just slightly larger than the narrow portion 26 of the protuberance 24 but less than the width of the enlarged portion 28 thereof. Thus, once the male snap connector 20 is received within the intermediate portion 40 of the slot 30, it cannot be removed therefrom. The purpose of this construction is to permit ease of assembly of the clips 32 to the cap frame. That is, the construction of the intermediate portion 40 of the slot 30 serves to capture the male snap connector 20 during assembly.

To permit insertion of the male snap connector 20 into the slot 30, the ends of the latter include enlarged portions 42 having a width just slightly greater than that of the enlarged portion 28 of the protuberance 24. Thus, as seen in FIG. 5, the male snap connector 20 may be inserted into the slot 30 through one of the end portions 42 and thereafter moved to the intermediate portion 40 to be captured thereby during the assembly operation.

As generally alluded to previously, the connecting means 18 are located, for example, at three points about the cap frame 10 in the illustrated embodiment at about 90° about the periphery thereof. Thus, female snap connecting elements 44 (FIG. 3) may be located about the periphery of the cover 14 at nominal 90° intervals so that there will be approximate alignment of female snap connectors 44 and the male snap connectors 20. One of the female snap connectors 44 may then be fixed to the male snap connector 16 for initial registration purposes. Thereafter, working about the periphery of the frame 10, each male snap connector 20 may be moved appropriately within the slot 30 in which it is received until it is in accurate registry with its corresponding female snap connector. The result is perfect registry of all snap connectors that totally eliminate any bunching of one segment of the cap cover and stretching of another and which permit different covers to be easily applied to the same frame as desired.

Referring now to FIG. 6, a modified embodiment of the invention is illustrated in connection with a piece of sheet-like material 100. Specifically, the connector shown in FIG. 6 includes a male snap connector element 20, identical to that illustrated in the embodiment shown in FIGS. 1–5 including a base 22 and a protuberance 24 as well as an intermediate portion 26 (not shown) having a lesser diameter than the more outwardly portion 28 of the protuberance 24. The same is received in a slot 30 in a clip 102. The slot 30 is identical to the slot 30 illustrated in connection with the embodiment shown in FIGS. 1–5 and includes a relatively narrow intermediate portion and enlarged portions 42 at the end thereof. The dimensioning of the slot 30 with respect to the male connector 20 is the same as that described previously.

The clip 102 differs from the clip 32 in that it is not formed of metal. Rather, the same may be formed of a relatively stiff material such as a plastic. It further differs from the clip 32 in that means for securing the same to the fabric 100 are not in the form of the pointed tabs employed with the clip 32, but rather, in terms of peripheral stitching 104. It is to be noted that the stitching 104 must be sufficiently exterior of the confines of the slot 30 so as to allow the base 22 of the male snap connector 20 to move freely between the clip 102 and the material 100 and without interference with the stitching.

It will be recognized that other securing means may be used depending upon the particular nature of the material 100. For example, if the same is formed of synthetic plastic, the securing could be accomplished by heat sealing or any of a variety of adhesives.

Figure 7:
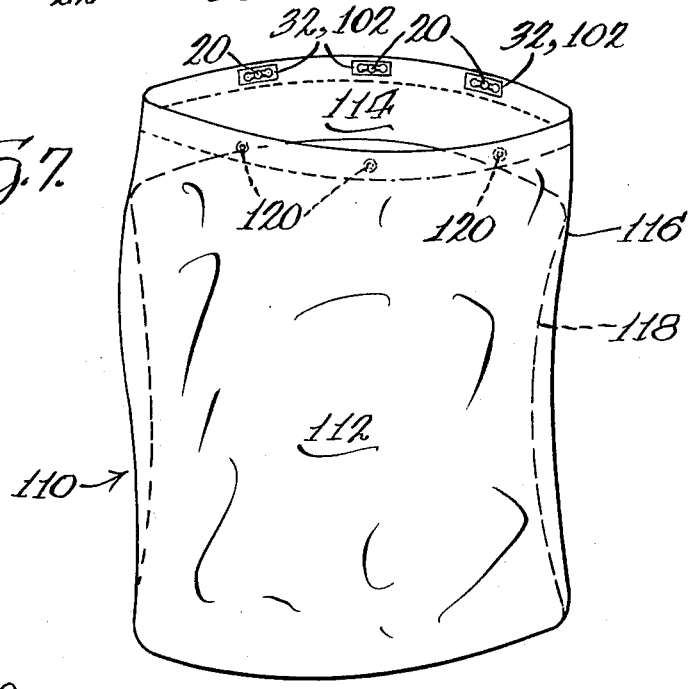
FIG. 7 illustrates an upholstery cover employing the invention.

FIG. 7 illustrates the invention employed in connection with any upholstery cover, generally designated 110. The upholstery cover may be formed of a front sheet of material 112 and a rear sheet of material 114 secured together about three sides by a seam to define a container-like cover for a pillow 118 or the like. At the upper end of the sheet 112 and facing the interior of the assemblage, there may be fixedly secured at any desired interval conventional female snap connectors 120. On the opposite side of the opening and on the inside of the sheet 114 near the upper edge thereof, there may be located the clips 32 or 102 having male snap fasteners 20 associated therewith. In general, in an assemblage such as that shown in FIG. 7, it is preferable to use an embodiment made according to FIG. 6 in that the presence of the securing tabs 34 would be undesirable. However, in some instances, this may not be a substantial distraction.

It will be recognized that the orientation of the various elements of each snap fastener are such that limited self-aligning movement with respect to each other and with respect to the seam 116 may take place thereby eliminating any bunching or stretching of the fabric between adjacent snap fasteners or seams.

Figure 8:
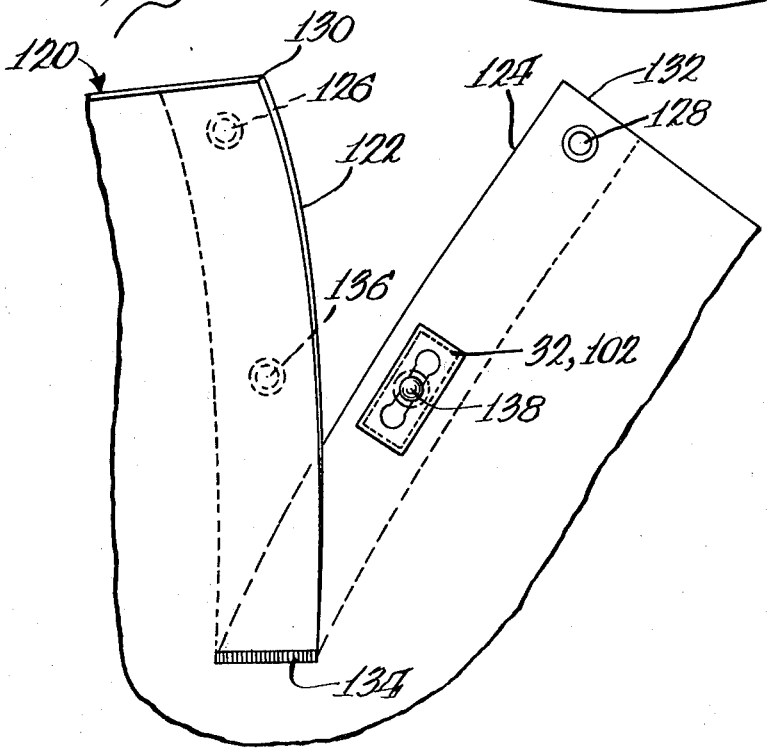
FIG. 8 illustrates the use of the invention in connection with the fly on an article of clothing.

FIG. 8 illustrates one use of the invention in connection with an article of clothing, generally designated 120, and specifically, a fly formed therein. It should be noted that the view illustrated in FIG. 8 is from the interior of the article of clothing for reasons that will become apparent hereinafter.

The fly includes an underlying flap 122 and an overlying flap 124. At the end of the fly, and on the underlying flap 122 there is provided a fixedly secured conventional female snap fastener 126 while on the interior of the overlying fly there is provided a conventional male snap connector 128. The male snap connector 128 is also fixedly secured to the fly so as to insure that the upper edges 130 and 132 of the fly will be in perfect alignment. This may be accomplished in a conventional fashion and is necessary to insure proper alignment.

Snap fasteners employed intermediate the connectors 126 and 128 and the secured end 134 of the fly embody the invention. As illustrated in FIG. 8, the underlying fly includes an intermediately located female snap connector 136, while the overlying fly includes a clip 32 or 102 associated with a male snap connector 138 which may be identical to the snap connector 20. Since the snap connector 138 is free to move within the clip, bunching and stretching intermediate the ends of the fly will be precluded.

Again, it will be recognized that it is preferable to employ a clip of the type illustrated in FIG. 6 in connection with articles of clothing as the presence of tabs 34 may not be desirable.

From the foregoing, it will be appreciated that accurate registry of parts of any of a variety of articles can be obtained through use of the invention. And, while experience has shown that the cost of a snap connector made according to the invention is slightly greater than conventional connectors, the accurate registry provided by the invention almost totally obviates the need for manual disassembly of improperly aligned snap connectors. As a result, the minimal increase in cost is offset many times by the savings in the labor required to realign improperly aligned snap connectors in such articles.

We claim:

1. A cap construction comprising: means defining a cap frame; means defining a cap cover adapted to be secured to said frame; means for securing said cover to said frame comprising a plurality of first elements on said cover and a plurality of second elements on said frame, corresponding ones of said first and second elements being constructed to cooperate with each other to secure said cover to said frame; and means on at least one of said cap and said frame mounting at least some of said first and second elements, respectively, for movement along the periphery of said cover and said frame, respectively, toward and away from adjoining cooperating elements whereby misalignment between said first and second elements may be selectively corrected to insure proper registry of said cover with respect to said frame when the two are secured together; the movable ones of said elements comprising male snap connectors, said mounting means comprising a plurality of elongated slots in said frame, each respectively receiving a male snap connector; each of said male snap connectors including an enlarged base and a lesser protuberance extending therefrom, said protuberance having a lesser cross section adjacent said base than at least one point removed from said base; and each said slot is configured to have a first portion of a dimension sufficiently large to permit said protuberance to pass freely therethrough and a second portion of lesser dimension for precluding passage of said protuberance therethrough, said second portion dimension being just slightly greater than the cross section of said protuberance adjacent said base whereby said male snap connector may be easily inserted in said slot at said first portion and moved to said second portion for retention therein during assembly of said cover to said frame; and a further male snap connector immovably affixed to said frame, the remainder of said male snap connectors all being mounted for movement in respective ones of said elongated slots.

2. A cap construction comprising: means defining a cap frame; means defining a cap cover adapted to be secured to said frame; means for securing said cover to said frame comprising a plurality of first elements on said cover and a plurality of second elements on said frame, corresponding ones of said first and second elements being constructed to cooperate with each other to secure said cover to said frame; and means on at least one of said cap and said frame mounting at least some of said first and second elements, respectively, for movement along the periphery of said cover and said frame, respectively, whereby misalignment between said first and second elements may be selectively corrected to insure proper registry of said cover with respect to said frame when the two are secured together; said first and second elements comprising mating snap connectors with the movable ones of said elements being male snap connectors, each said male snap connector including a base and a protuberance extending therefrom; said mounting means comprising a plurality of elongated metal clips having tabs thereon penetrating said frame to fasten the corresponding clip to said frame, each said clip including an elongated slot receiving a corresponding one of said male snap connectors such that the protuberance thereof extends through said slot and the base thereof is sandwiched between said clip and said frame; said protuberance having a portion of lesser dimension than the remainder of said protuberance and located intermediate the ends thereof; and said slot including a first portion through which said protuberance may freely pass and a second portion having a dimension just slightly larger than said lesser dimension portion and smaller than said remaining portion of said protuberance whereby said male snap connector may freely enter said slot through said first portion and be retained therein when moved along the same to said second portion; and further including an additional male snap connector immovably affixed to said frame and a corresponding mating snap connector on said cover, said additional male snap connector serving to initially register said cover with respect to said frame.

3. A cap construction comprising: means defining a cap frame; means defining a cap cover adapted to be secured to said frame; means for securing said cover to said frame comprising a plurality of first elements on said cover and a plurality of second elements on said frame, corresponding ones of said first and second elements being constructed to cooperate with each other to secure said cover to said frame; and means on at least one of said cap and said frame mounting at least some of said first and second elements, respectively, for movement along the periphery of said cover and said frame, respectively, toward and away from adjoining cooperating elements whereby misalignment between said first and second elements may be selectively corrected to insure proper registry of said cover with respect to said frame when the two are secured together; the movable ones of said elements comprising male snap connectors having an enlarged base and a lesser protuberance extending therefrom, said mounting means comprising a plurality of elongated slots in said frame, each respectively receiving the protuberance of a male snap connector and a further male snap connector immovably affixed to said frame, the remainder of said male snap connectors all being mounted for movement in respective ones of said elongated slots.

* * * * *